United States Patent [19]

Blair et al.

[11] Patent Number: 5,040,708

[45] Date of Patent: Aug. 20, 1991

[54] CADDY FOR NEEDLE PUNCH TOOLS AND SPOOLS OF THREAD

[76] Inventors: Richard Blair; Barbara E. Blair, both of 7480 El Dorado Dr., Buena Park, Calif. 90620

[21] Appl. No.: 600,525

[22] Filed: Oct. 19, 1990

[51] Int. Cl.[5] ..... A41H 31/00

[52] U.S. Cl. ..... 223/106; 223/108; 223/120; 223/99; 206/391

[58] Field of Search ..... 223/106, 108, 107, 109 R, 223/120, 99; 206/391, 392, 49

[56] References Cited

U.S. PATENT DOCUMENTS

| | | | |
|---|---|---|---|
| 1,962,325 | 6/1934 | Oldham | 223/109 R |
| 1,965,468 | 7/1934 | Ostrander | 223/109 |
| 3,322,310 | 5/1967 | Higgs | 223/107 |
| 3,948,396 | 4/1976 | Upton et al. | 223/106 X |
| 4,088,380 | 5/1978 | Watts | 223/106 X |
| 4,351,458 | 4/1982 | Wolfe | 223/106 |
| 5,002,211 | 3/1991 | Caldwell et al. | 223/106 X |

*Primary Examiner*—Werner H. Schroeder
*Assistant Examiner*—Bibhu Mohanty
*Attorney, Agent, or Firm*—Ben E. Lofstedt

[57] ABSTRACT

A caddy for needle punch needles, a needle threader and spools of threads including a base, a backwall secured to one end of the bases and rising upwardly therefrom, a plurality of receptacles in the backwall for receiving needle punch tools, such as needles and the like, a plurality of vertically arranged rods secured to the base for receiving spools of thread, and a needle threader receptacle secured to the backwall, said receptacle so formed that when the needle threader is inserted thereinto, the body of the needle threader is caused to bend slightly along its length to create a biasing force between the receptacle and the needle threader thereby preventing free relative movement between the needle threader and the receptacle.

10 Claims, 2 Drawing Sheets

CADDY FOR NEEDLE PUNCH TOOLS AND SPOOLS OF THREAD

DESCRIPTION OF THE INVENTION

1. Field of the Invention

This invention relates to a caddy for holding needle-like tools and spools of thread, and, more particularly, to a caddy for holding needle punch tools and spools of thread presenting each item for use by the needle punch user.

2. Background of the Invention

One of the increasing popular pastimes or hobbies is the art and practice of needle punch. Various colors and types of threads are mounted in a sharp, hollow needle and the needle, with the thread, is "punched" through a fabric, such as a shirt, or piece of cloth, and then withdrawn, leaving a "loop" of the thread mounted in the fabric through with the needle was punched. Thousands of times, the needle and thread are punched through the fabric to form a dense, tightly packed carpet-like work of art. By varying the depth of the punch, a "sculptured" carpeting look is achieved, similar to a bias-relief map. Use of different types of threaded materials provides for varying textures in the needle punch work.

One of the perplexing problems facing the needle puncher is where to conveniently store, ready for use, the numerous types, colors, and lengths of threads required in the creation of needle punch work of art. Merely keeping the spools of thread in a bag invites confusion and frustration.

Another problem is that some of the types of threads used in this art form are relatively expensive and relatively fragile. Such threads are easily damaged to the point where such thread cannot be used in needle punch work. The loss of such thread is not only inconvenient, but expensive as well.

A problem of even greater significance, is the use of the varying sizes and types of very sharp needles in needle punch work. The needles must be very sharp and durable in order to allow the needles to punch through the base fabric thousands of times in the creation of a needle punch work of art. Because such needles are very sharp, they pose a safety hazard to both user, children, pets, and friends. This is especially true because needle punch work is done by many as a pastime on vacation, or while traveling as a passenger in a vehicle, such as an automobile. During such trips, pets, children, and other people are frequently in close proximity to the needle punch worker and may not realize the danger or safety hazard presented by such sharp needles. Consequently, there is a definite need for a means for transporting such sharp needles safely so as not to pose a hazard to the unwary, yet allowing the needle punch user to conveniently access for use of these various sharp needles.

One of the really necessary tools used in needle punch work, is the threader. This is a device for threading the needles. A threader usually consists of a loop of very fine, small diameter steel wire. Because of the small diametered wire is used, a threader is readily misplaced or lost because it is difficult to see. Placing it in a bag, along with the other needle punch items and spools of thread is neither practical nor recommended.

SUMMARY OF THE INVENTION AND OBJECTS

Fundamentally, the present invention is a caddy for needle punch needles, a needle threader, and spools of threads. It includes a base, a backwall secured to one end of the base and rising upwardly therefrom, a plurality of receptacles in the backwall for receiving needle punch tools, such as needles and the like, a plurality of vertically arranged rods secured to the base for receiving spools of thread, and a needle threader receptacle means secured to the backwall, said receptacle means so formed that when the needle threader is inserted thereinto, the body of the needle threader is caused to bend slightly along its length to create a biasing force between the receptacle and the needle threader thereby preventing free relative movement between the needle threader and the receptacle means.

One object of the instant invention is to provide a caddy for safely holding for use and transportation various needle punch tools and spools of thread.

Another object of the present invention is to provide a means for holding for use and transporting needle punch needles wherein the needle points are stored in such a manner that the points of the needles do not contact anything while being stored.

A yet still further object of the invention is to provide a caddy which presents smooth, snag-free surfaces to the spools for thread carried thereon.

One important and primary object of the invention is to provide a carrier for the needle threader which maintains the needle threader in a relatively fixed storage position until it is manually removed or inserted by the needle punch worker.

One yet still further and important objective of the invention is to provide a caddy which is readily transportable and is durable.

Further objects, features and advantages of the instant invention will become apparent from the following description and claims, and from the accompanying drawings wherein:

DETAILED DESCRIPTION OF THE PREFERRED EMBODIMENT

Figure 1:
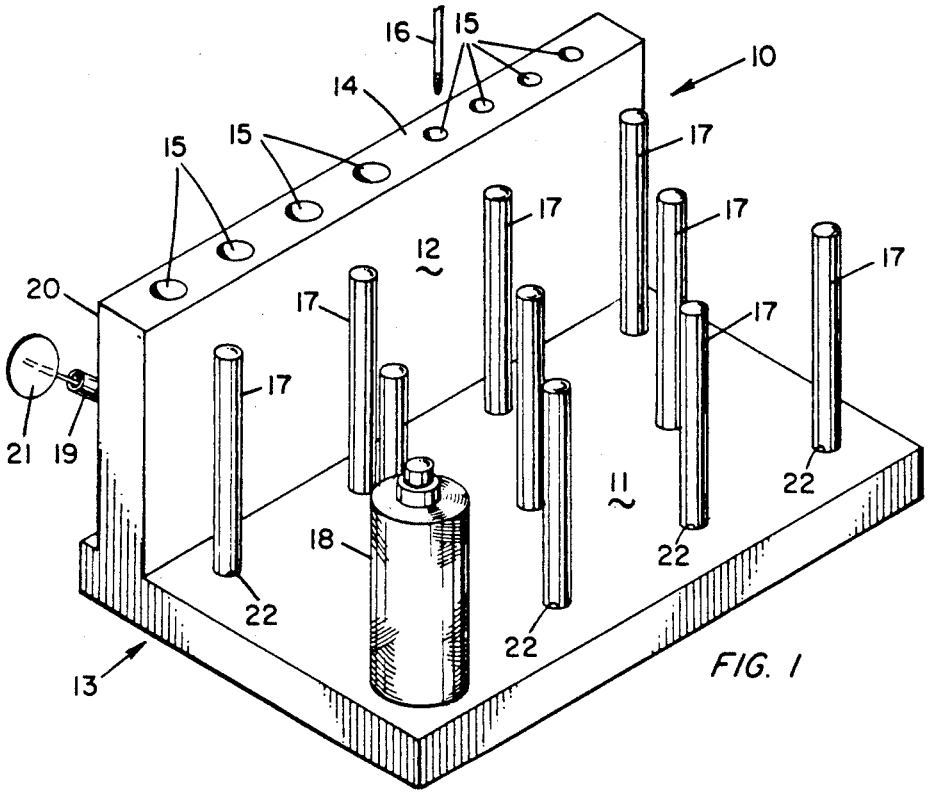
FIG. 1 is a perspective view of the invention.
Figure 2:
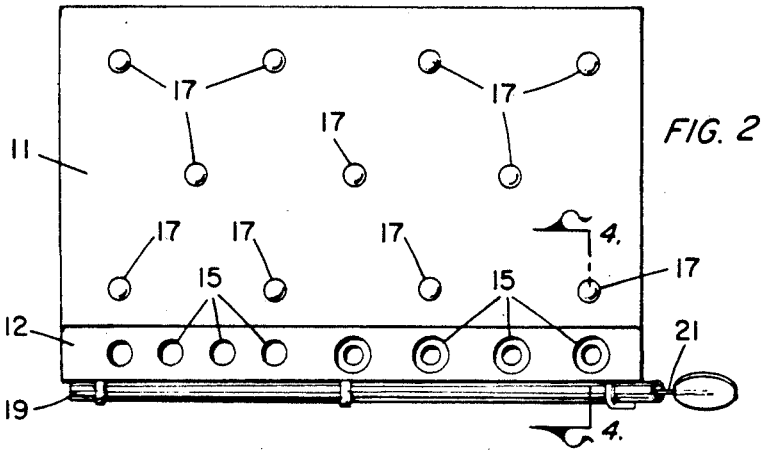
FIG. 2 is top view of the present invention.
Figure 3:
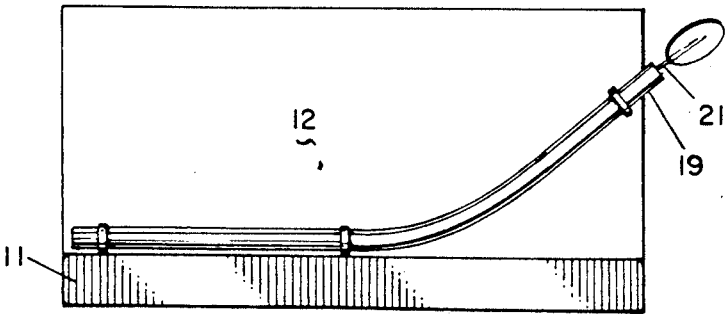
FIG. 3 is a rear view of the instant invention and the storing of the needle threader.

With continuing reference now to all of the Drawings herein, and with special reference now to FIG. 1 of the Drawings, there is shown and described one preferred embodiment of the present invention, referred to as a caddy for needle punch needles, needle threader and spools of thread and generally indicated at 10.

The caddy for needle punch tools and spools of threads 10 basically includes a base 11, a backwall 12 secured to one end 13 of the base 11, the upper edge 14 of the backwall 12 having a plurality of receptacles 15 therein for receiving needle punch tools, such as needles 16 and the like, a plurality of vertically arranged rods 17 mounted in the base 11 for receiving spools of thread 18, and an arcuately shaped tube 19 secured to the outside facing portion 20 of the backwall 12.

Figure 4:
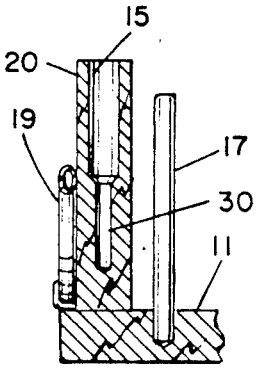
FIG. 4 is a sectional view taken along Plane A—A of FIG. 2 of the drawings.

In one preferred form of the preferred embodiment of the invention, the plurality of receptacles 15 consist of a plurality of vertically-arranged passageways formed by drilling into the uppermost edge of the vertically-disposed backwall 12. The receptacles 15 thereby formed can either be of a single diametered drill hole or a dual diametered drill hole, which includes a smaller diametered drill hole or passageway 30 such as shown in FIG. 4 of the drawings. The primary purposes of such receptacles 15 formed by drill holes or passageways is to safely support and stow the sharp needle punch tools without the sharp needle from contacting any surface which would dull the sharp point of the needle.

The function and purpose of the horizontal base 11 is to provide a platform for supporting all of the rest of the various elements as hereinbefore and hereinafterwards described.

The rods 17 are mounted securely to the base 11 preferably by drilling holes 22 in the base 11 which is slightly larger than the diameter of the corresponding rod 17 to be mated with the corresponding hole 22 in the base 11. The placement of the rods 17 are arranged to provide optimum clearance between the spools 18 of thread.

The rods 17 which are adjacent to the inside facing backwall 12 are specially spaced therefrom to restrict the use of these rods 17 to only the very fine, fragile, expensive small diametered spools of thread for added protection for such spools of thread against snagging and contact with other objects which might damage such delicate materials.

It should be noted that while the caddy 10 can be constructed of any type of material which provides a snag-free environment for the thread on the spools of thread, it may be readily constructed of wood, such as pine. In order to do so, however, the wood must be sanded very smooth using a very fine grade of sandpaper, such as 200 grit or finer. After this is finished, a heavy coat of sealer should be used to finish the wood.

Mounted to the outside facing portion 20 of the backwall 12 is a small diametered plastic tube 19, or the like, into which is placed and stored the needle threader 21. As previously discussed, such a needle threader 21 is usually formed of very small diametered steel wire material and without such a separate storage place it may be readily lost or otherwise damaged so as to render it not useable.

Figure 5:
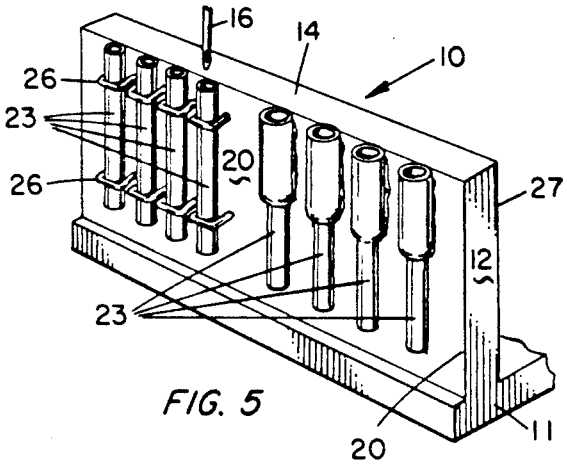
FIG. 5 depicts an alternative embodiment of storage for the needle punch needles with respect to the present invention.

Turning now to FIG. 5 of the Drawings herein, there is shown and illustrated an alternative embodiment of storage for the needle punch needles 16 with respect to the present invention 10. A plurality of tubes 23 are secured to the backwall 12. Two methods by which this can be accomplished are by the use of U-shaped staples 26, or by adhesively bonding the tubes 23 to the backwall 12 along either the inside facing portion 27 or the outside facing portion 20 of the backwall 12.

Figure 6:
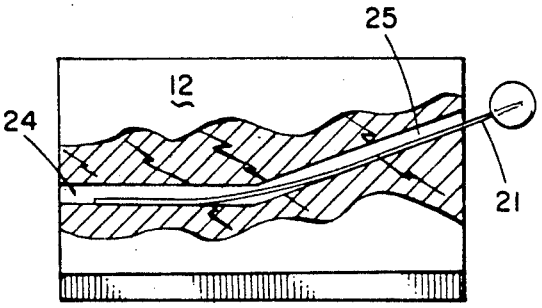
FIG. 6 shows an alternate embodiment for storing the needle threader in the backwall.

Drawing our attention now specifically to FIG. 6, there is shown an alternate embodiment for storing the needle threader 21 in the backwall 12. This is accomplished by drilling two passageways 24 and 25 from opposite sides of the backwall 12 with the two passageways 24 and 25 so as to join the two passageways in such a manner so as to dispose the two passageways at an obtuse angle with respect to each other. By doing so, when the needle threader 21, which is typically formed from a loop of small diametered steel wire, is inserted thereinto, the wire is forced to be bent slightly thereby creating a natural bias with respect to the passageways 24 and 25 so that the needle threader 21 will be retained therein until the needle punch worker intentionally withdraws the needle threader 21 from the passageways 24 and 25.

Figure 7:
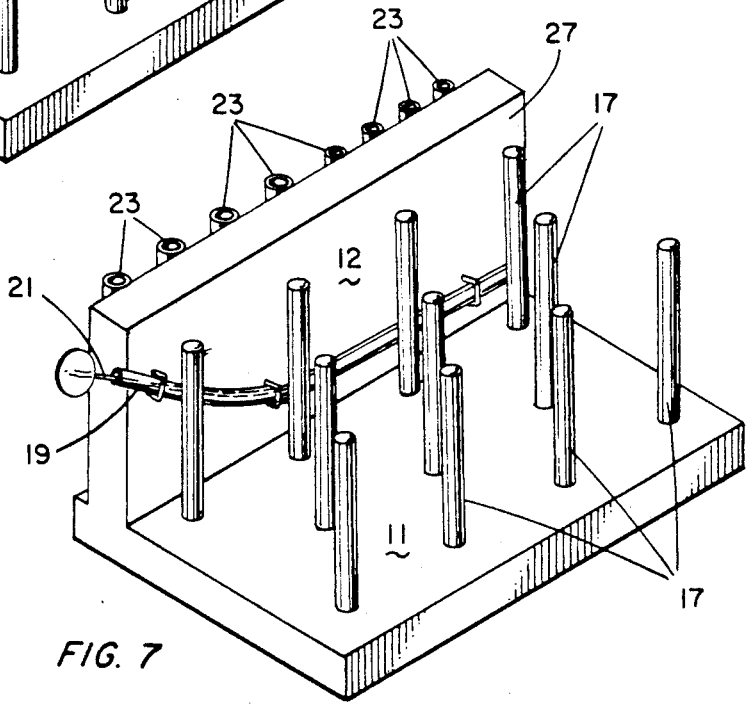
FIG. 7 illustrates another alternate embodiment for storing the needle threader on the backwall.

FIG. 7 illustrates another alternate embodiment for storing the needle threader 21 on the inside facing portion 27 of the backwall 12 in the same manner as previously disclosed with respect to the outside facing portion 20 of the backwall 12. As shown in FIG. 1, the tube 19 can be either stapled or glued to the inside facing portion 27 of the backwall 12. This, of course, is to arrange the tube 19 in the form of arc so that the steel wire forming the needle threader 21 is bent slightly to self-biased it within the tube 19 so that the needle threader 21 cannot freely fall out thereof, but requires manual force by the needle punch worker to remove the needle threader 21 from its place of storage.

Figure 8:
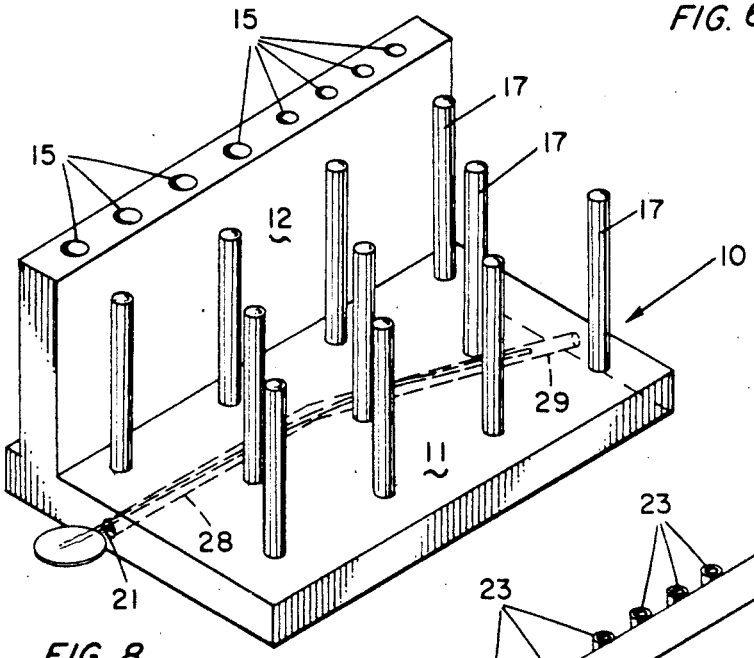
FIG. 8 shows a yet another embodiment for storing the needle threader in the base.

FIG. 8 shows a yet another embodiment for storage for a needle threader 21 in the base 11. This is accomplished by drilling two passageways 28 and 29 from opposite sides of the base 11 with the two passageways 28 and 29 so as to join the passageways in such a manner as to dispose the two at an obtuse angle with respect to each other. By doing this, the needle threader 21, which is typically formed from small diametered steel wire, is inserted thereinto, it is forced to be bent slightly thereby creating a natural bias with respect to the passageways 28 and 29 so that the needle threader 21 will be retained therein until the needle punch worker intentionally withdraws the needle threader 21 from the passageways 28 and 29.

Other modifications and changes will occur to those skilled in the art to which this invention pertains. It should be clearly understood, however, that such obvious modifications and changes will not depart from the spirit and scope of the invention disclosed and embodied herein, such changes and modifications being encompassed within the bonds of the scope of the within invention.

What we claim as our invention is:

1. A storage caddy for needle punch tools, a needle threader and spools of thread, comprising:

(a) a base;

(b) a backwall, secured to one end of the base and rising upwardly therefrom;

(c) receptacle means for receiving needle punch tools, said means being operably associated with the backwall;

(d) a plurality of vertically arranged rods secured to the base for receiving spools of thread; and (e) a needle threader receptacle, said receptacle so formed that when the needle threader is inserted thereinto, the body of the needle threader is caused to bend slightly along its length to create a biasing force between the needle threader receptacle and the needle threader thereby preventing free relative movement between the needle threader and the needle threader receptacle.

2. The storage caddy for needle punch needles, a needle threader and spools of thread of claim 1, wherein said base is formed of wood which is sanded smooth with a very fine grade of sandpaper, such as 200 grit or finer.

3. The storage caddy for needle punch tools, a needle threader and spools of thread of claim 1, wherein said base is formed of wood which is sanded smooth with a very fine grade of sandpaper, such as 200 grit or finer, is coated with a sealer to finish the wood.

4. The storage caddy for needle punch tools, a needle threader and spools of thread of claim 1, wherein the receptacle means for receiving needle punch tools comprises a plurality of vertically-arranged passageways formed into the body of the backwall and having an exit along the uppermost edge of said vertically-disposed backwall.

5. The storage caddy for needle punch tools, a needle threader and spools of thread of claim 4 wherein said vertically-arranged passageways formed into the body of the backwall are essentially single diametered.

6. The storage caddy for needle punch tools, a needle threader and spools of thread of claim 4 wherein said vertically-arranged passageways formed into the body of the backwall are dual diametered.

7. The storage caddy for needle punch needles, a needle threader and spools of thread of claim 1, wherein the receptacle means for receiving needle- punch tools comprises a plurality of vertically-arranged tubes secured to the outside facing surface of the backwall.

8. The storage caddy for needle punch tools, a needle threader and spools of thread of claim 1, wherein the needle threader receptacle comprises a pair of passageways angled to form an obtuse angle with respect to each other formed in the base.

9. The storage caddy for needle punch tools, a needle threader and spools of thread of claim 1, wherein the needle threader receptacle comprises a pair of passageways angled to form an obtuse angle with respect to each other formed in the backwall.

10. The storage caddy for needle punch tools, a needle threader and spools of thread of claim 1, wherein the needle threader receptacle comprises a tube angled to form an obtuse angle with respect to the ends of the tube thereof which is secured to backwall.

* * * * *